US009122234B2

(12) United States Patent
Murashima

(10) Patent No.: US 9,122,234 B2
(45) Date of Patent: Sep. 1, 2015

(54) RECORDING MEDIUM CONVEYING MECHANISM AND IMAGE FORMING APPARATUS HAVING THE SAME

(71) Applicant: KYOCERA Document Solutions Inc., Osaka (JP)

(72) Inventor: Masaki Murashima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 25 days.

(21) Appl. No.: 14/192,593

(22) Filed: Feb. 27, 2014

(65) Prior Publication Data

US 2014/0241777 A1 Aug. 28, 2014

(30) Foreign Application Priority Data

Feb. 28, 2013 (JP) ..... 2013-040161

(51) Int. Cl.
*G03G 21/16* (2006.01)

(52) U.S. Cl.
CPC ..... *G03G 21/168* (2013.01)

(58) Field of Classification Search
CPC ..... G03G 21/168; G03G 2221/1615; G03G 2221/1642; G03G 2215/00139; G03G 2215/1623; G03G 21/1846; G03G 2215/00409
See application file for complete search history.

(56) References Cited

U.S. PATENT DOCUMENTS

| | | | | |
|---|---|---|---|---|
| 2006/0045580 | A1* | 3/2006 | Matsuura | 399/316 |
| 2006/0180973 | A1* | 8/2006 | Igarashi | 271/4.01 |
| 2007/0269233 | A1* | 11/2007 | Sakashita et al. | 399/110 |
| 2008/0122168 | A1* | 5/2008 | Higashimura et al. | 271/275 |
| 2009/0166966 | A1* | 7/2009 | Nishikata et al. | 271/272 |
| 2009/0297241 | A1* | 12/2009 | Kim et al. | 399/388 |
| 2010/0196046 | A1* | 8/2010 | Shimizu | 399/110 |
| 2010/0247142 | A1* | 9/2010 | Kikuchi et al. | 399/112 |
| 2011/0081188 | A1* | 4/2011 | Kaseda | 400/611 |

FOREIGN PATENT DOCUMENTS

JP 2005-070218 A 3/2005

* cited by examiner

*Primary Examiner* — Daniel J Colilla
*Assistant Examiner* — Ruben Parco, Jr.
(74) *Attorney, Agent, or Firm* — Knobbe, Martens Olson & Bear, LLP

(57) ABSTRACT

A recording medium conveying mechanism includes a conveying guide, a guide member, and a rotating mechanism. The conveying guide conveys recording paper to a nip zone between a mountable/demountable intermediate transfer unit and a secondary transfer roller. The guide member acting as a part of the conveying guide is rotated by the rotating mechanism so that a tip thereof is disposed up to a position just adjacent to the nip zone when the intermediate transfer unit is mounted in the apparatus main body. When the intermediate transfer unit is mounted/demounted in/from the apparatus main body, the guide member is rotated up to a position at which the tip thereof does not exceed an arrangement position of the intermediate transfer belt portion in a conveying direction of the recording paper, in a movement direction of the intermediate transfer unit during the mounting/demounting.

5 Claims, 11 Drawing Sheets

RECORDING MEDIUM CONVEYING MECHANISM AND IMAGE FORMING APPARATUS HAVING THE SAME

INCORPORATION BY REFERENCE

This application claims priority to Japanese Patent Application No. 2013-40161 filed on Feb. 28, 2013, the entire contents of which are incorporated by reference herein.

BACKGROUND

The present disclosure relates to a recording medium conveying mechanism and an image forming apparatus having the same, and particularly to a structure for conveying recording paper disposed around an intermediate transfer unit.

Electrophotographic image forming apparatuses have various structures and types, one of which is an intermediate transfer type in which a color image is formed. The image forming apparatus of the intermediate transfer type is configured so that toner images of respective colors are transferred to an intermediate transfer belt (primary transfer), after which the corresponding toner images are transferred to recording paper again (secondary transfer), and the image is fixed to the recording paper by thermocompression. In the image forming apparatus, the intermediate transfer belt, a driving roller stretching the intermediate transfer belt, and a tension roller are unified as an intermediate transfer unit, and are adapted to be demounted from an apparatus main body of the image forming apparatus along with the unit in the event of maintenance and replacement. Further, in case of another image forming apparatus, a main body lateral face of the side of a secondary transfer roller is opened, and a nip zone between the intermediate transfer belt stretched on the roller and the secondary transfer roller is released, the intermediate transfer unit is adapted to be able to be demounted from the side of the secondary transfer roller.

SUMMARY

A recording medium conveying mechanism according to an aspect of the present disclosure includes a conveying guide, a guide member, and a rotating mechanism.

The conveying guide is configured so that a tip thereof runs up to a nip zone between an intermediate transfer belt mounted on an intermediate transfer unit and a secondary transfer roller disposed to face the intermediate transfer belt beyond an arrangement position of a portion of the intermediate transfer belt at an uppermost stream side in an conveying direction of a recording medium, and guides movement of the recording medium conveyed toward the nip zone.

The guide member is a portion of the conveying guide having the tip, is rotated when the intermediate transfer unit is mounted/demounted relative to an apparatus main body of an image forming apparatus, and is rotated up to a position, at which the tip does not exceed the arrangement position of the intermediate transfer belt portion in the conveying direction of the recording medium when the intermediate transfer unit is mounted/demounted, in a movement direction of the intermediate transfer unit during the mounting/demounting.

The rotating mechanism rotates the guide member.

Further, an image forming apparatus according to another aspect of the present disclosure includes the recording medium conveying mechanism, the intermediate transfer unit, the secondary transfer roller, and a locking mechanism.

The locking mechanism switches restriction of the movement of the intermediate transfer unit mounted in the apparatus main body in the movement direction during the demounting, and release of the restriction.

The image forming apparatus is configured so that, when the movement restriction caused by the locking mechanism is released when the intermediate transfer unit is demounted from the apparatus main body, the pressing member presses the engaging part, and the intermediate transfer unit moves in the direction during the demounting.

DETAILED DESCRIPTION

Figure 1:
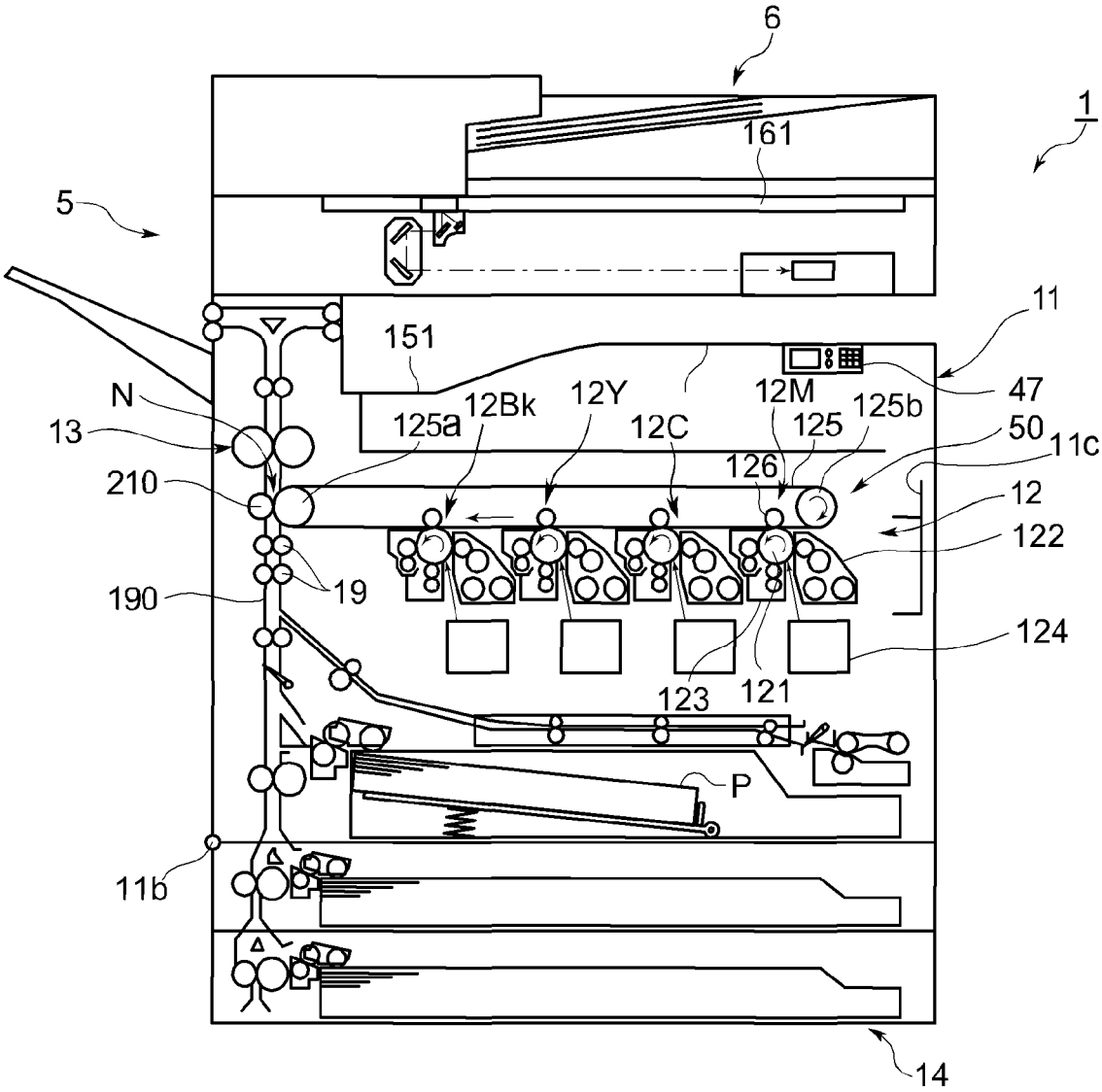
FIG. 1 is a front cross-sectional view showing a structure of an image forming apparatus according to an embodiment of the present disclosure.

Hereinafter, a recording medium conveying mechanism and an image forming apparatus according to an embodiment will be described as an aspect of the present disclosure with reference to the drawings. FIG. 1 is a front cross-sectional view showing a structure of an image forming apparatus 1 according to an embodiment of the present disclosure.

An image forming apparatus 1 according to an embodiment of the present disclosure is a multifunction device combining a plurality of functions such as a copy function, a printer function, a scanner function, and a facsimile function. The image forming apparatus 1 includes an apparatus main body 11 that is equipped with an operation unit 47, an image forming unit 12, a fixing unit 13, a paper feed unit 14, a document conveying unit 6, and an image reading unit 5. The image forming apparatus 1 is equipped with a recording medium conveying mechanism according to an embodiment of the present disclosure.

The operation unit 47 receives instructions, such as an instruction to implement an image forming operation and an instruction to implement a document reading operation, from an operator with regard to various operations and processes which can be implemented by the image forming apparatus 1.

When the image forming apparatus 1 performs the document reading operation, the image reading unit 5 optically reads an image of a document fed by the document conveying unit 6 or a document placed on a document table glass 161 to generate image data. The image data generated by the image reading unit 5 is stored in an internal hard disk drive (HDD) or a networked computer.

When the image forming apparatus 1 performs the image forming operation, the image forming unit 12 forms toner images on recording paper (an example of a recording medium) P as a recording medium fed from the paper feed unit 14 based on the image data generated by the document reading operation, the image data received from the networked computer, or the image data stored in the internal HDD. Image forming units 12M, 12C, 12Y, and 12Bk of the image forming unit 12 are each equipped with a photosensitive drum 121, a developing device 122 supplying toner to the photosensitive drum 121, a toner cartridge (not shown) containing the toner, a charging device 123, an exposure device 124, and a primary transfer roller 126.

When color printing is carried out, the image forming unit 12M for magenta, the image forming unit 12C for cyan, the image forming unit 12Y for yellow, and the image forming unit 12Bk for black of the image forming unit 12 form the toner images on the photosensitive drums 121 based on images composed of respective color components constituting the image data by charging, exposure, and developing processes, and cause the toner images to be transferred to an intermediate transfer belt 125 stretched on a driving roller 125*a* and a driven roller 125*b* by the primary transfer rollers 126.

The intermediate transfer belt 125 has an image carrying surface which is set to an outer circumferential surface thereof and to which the toner images are transferred, and is driven in contact with circumferential surfaces of the photosensitive drums 121 by the driving roller 125*a*. The intermediate transfer belt 125 endlessly runs between the driving roller 125*a* and the driven roller 125*b* while being synchronized with each photosensitive drum 121.

Further, the intermediate transfer belt 125, the primary transfer roller 126, the driving roller 125*a*, and the driven roller 125*b* are mounted on an intermediate transfer unit 50.

The toner images of the respective colors which are transferred to the intermediate transfer belt 125 are superimposed on the intermediate transfer belt 125 by adjusting transfer timing, thereby becoming a color toner image. A secondary transfer roller 210 causes the color toner image formed on the surface of the intermediate transfer belt 125 to be transferred to the recording paper P, which is conveyed from the paper feed unit 14 along a conveying path 190, at a nip zone N at which the intermediate transfer belt 125 is sandwiched between the secondary transfer roller 210 and the driving roller 125*a*. Afterwards, the fixing unit 13 causes the toner image on the recording paper P to be fixed to the recording paper P by thermocompression. The recording paper P on which the color image undergoing the fixing process is formed is ejected to an eject tray 151.

Figure 2:
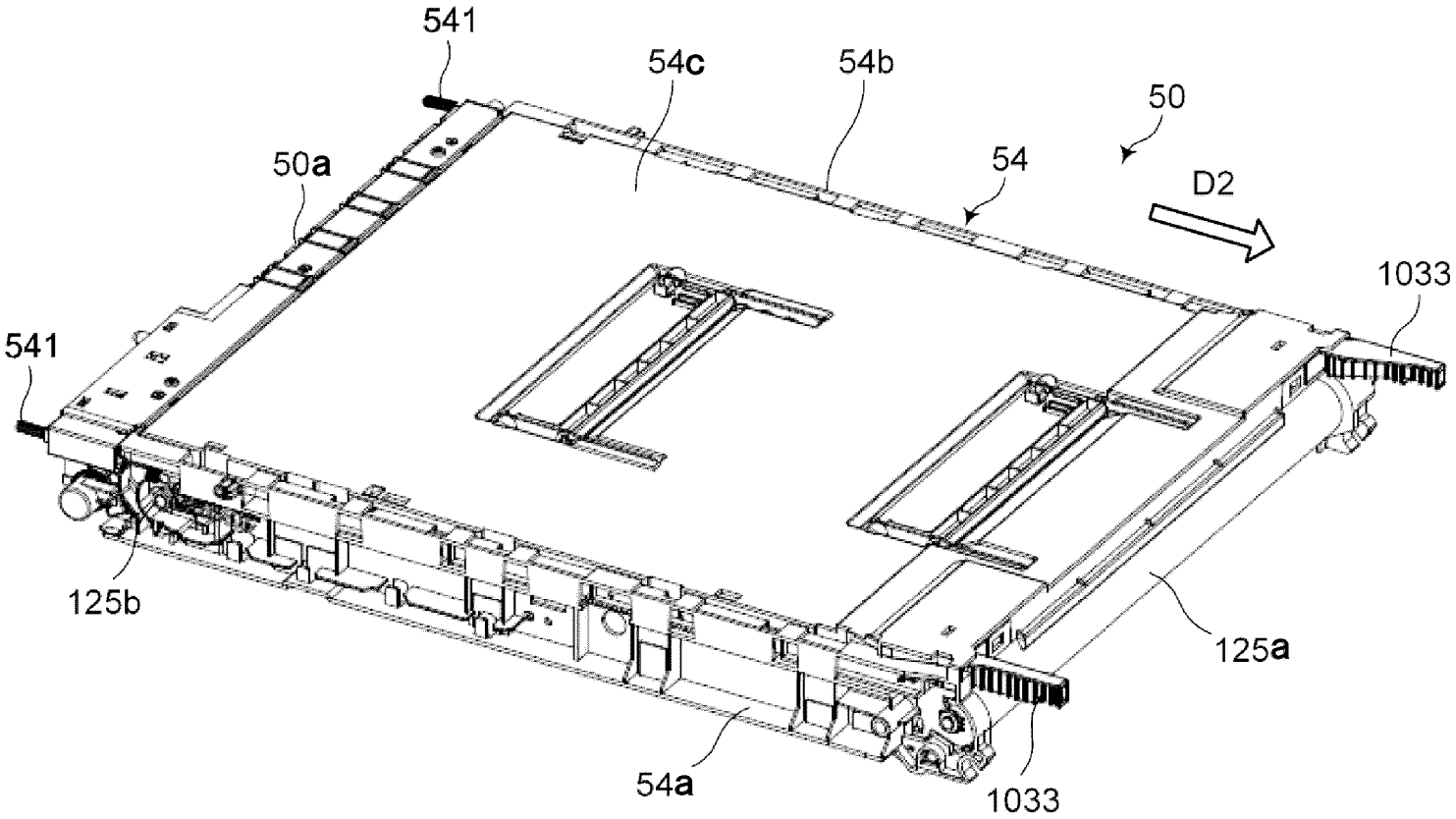
FIG. 2 is a perspective view showing an appearance of an intermediate transfer unit.
Figure 3:
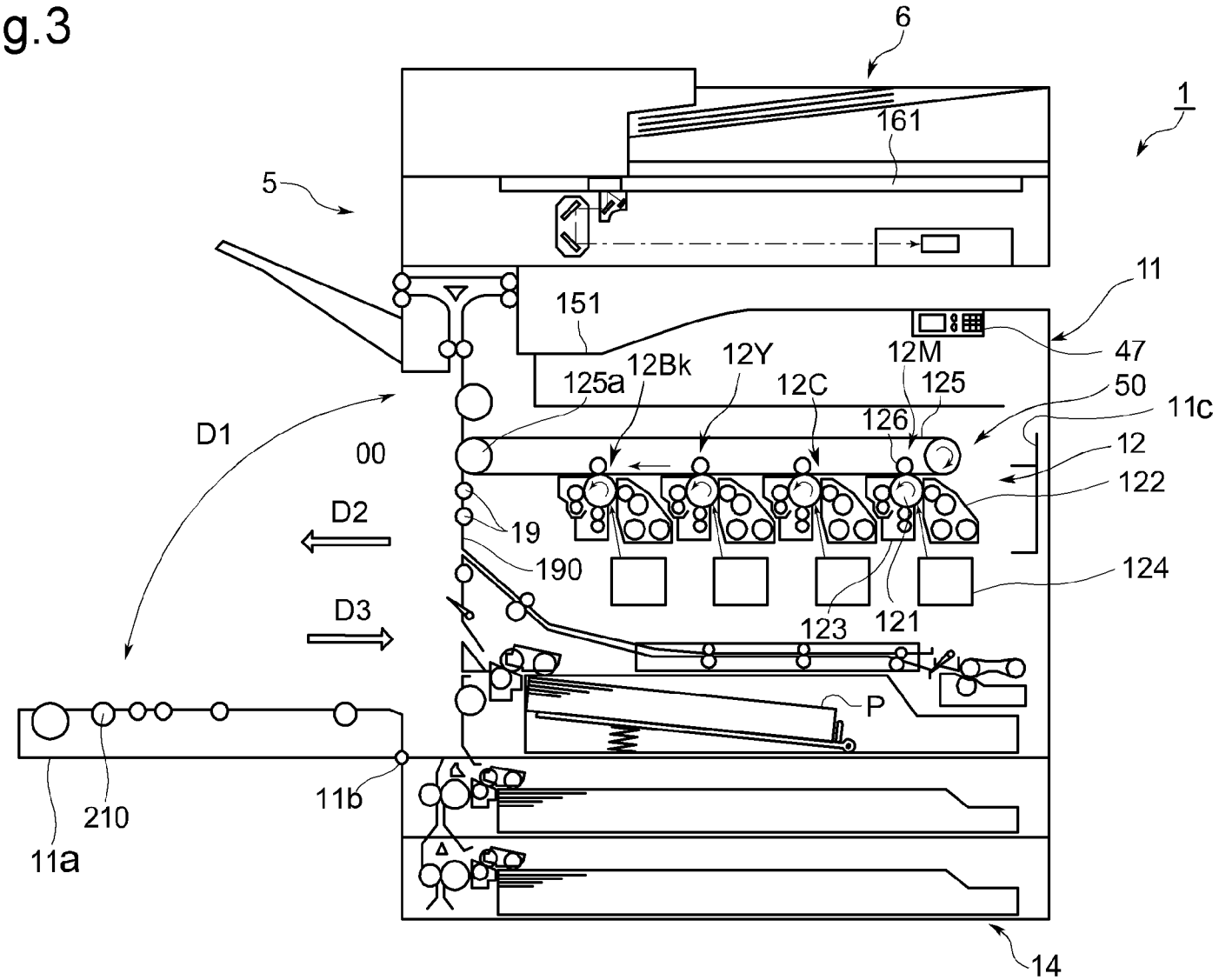
FIG. 3 is a view showing opening/closing of a door installed on the image forming apparatus.

Next, the intermediate transfer unit 50 will be described. FIG. 2 is a perspective view showing an appearance of the intermediate transfer unit 50. FIG. 3 is a view showing opening/closing of a door installed on the image forming apparatus 1.

The intermediate transfer unit 50 is configured to be detachably installed in the apparatus main body 11. As described above, the intermediate transfer unit 50 mounts the intermediate transfer belt 125, the primary transfer roller 126, the driving roller 125*a*, and the driven roller 125*b*.

The intermediate transfer unit 50 is equipped with a casing 54. Each mechanism with which the intermediate transfer unit 50 is equipped is mounted in the casing 54. The casing 54 is made up of an upper surface portion 54*c* and lateral surface portions 54*a* and 54*b* provided for edges of the upper surface portion 54*c*. The driving roller 125*a* is rotatably supported on one end of the casing 54, and the driven roller 125*b* is supported on the other end of the casing 54.

In the state in which the intermediate transfer belt 125 is stretched between the driving roller 125*a* and the driven roller 125*b* supported in this way, an upper part and both lateral parts of the intermediate transfer belt 125 are covered by the casing 54 made up of the upper surface portion 54*c* and the lateral surface portions 54*a* and 54*b*. In FIG. 2, a lower portion of the intermediate transfer belt 125 is kept exposed from the casing 54. In the state in which the intermediate transfer unit 50 is mounted in the apparatus main body 11, the image forming units for respective colors are arranged in the apparatus main body 11 below the portion of the exposed intermediate transfer belt 125.

Further, as shown in FIG. 3, a lateral portion of the apparatus main body 11 is provided with an openable door 11*a*. A part of the lateral portion of the apparatus main body 11 serves as the door 11*a*. The door 11*a* is rotated in a contacting/separating direction D1 for the image forming unit 12 in the apparatus main body 11 using a rotating shaft 11*b* as a rotating axis. A unilateral portion of the conveying path 190 is disposed on the door 11*a*. A conveyance roller 19 and the secondary transfer roller 210 arranged on the unilateral portion of the conveying path 190 are also disposed on the door 11*a*. For this reason, when the door 11*a* is rotated from the apparatus main body 11 in the separating direction, the secondary transfer roller 210 provided for the door 11*a* is separated from the driving roller 125*a* of the intermediate transfer unit 50, and splits the conveying path 190. Thus, the portion of the intermediate transfer unit 50 in the apparatus main body 11 is exposed.

When the door 11*a* is rotated in the state shown in FIG. 3, the driving roller 125*a* of the intermediate transfer unit 50 and the portion of the casing 54 in which the driving roller 125*a* is arranged are exposed. The portion of the exposed casing 54 is provided with levers 1033 (FIG. 2). When an operator grasps the levers 1033 to draw the intermediate transfer unit 50 in a drawing direction D2 shown in FIGS. 2 and 3, the intermediate transfer unit 50 deviates from the apparatus main body 11, and is drawn out of the apparatus main body 11.

Further, when the intermediate transfer unit 50 is mounted in the apparatus main body 11, in the state shown in FIG. 3 in which the door 11*a* is rotated, and the inside of the apparatus main body 11 is open, an operator inserts the intermediate transfer unit 50 from an end 50*a* on a side on which the driven roller 125*b* is mounted in an inserting direction D3 shown in FIG. 3 with respect to the apparatus main body 11. The end 50*a* is provided with protrusions 541. An example in which the number of protrusions 541 is two is shown in FIG. 2. However, only one of the protrusions 541 may be provided. In the vicinity of an internal face 11*c* in the apparatus main body 11, recesses into which the protrusions 541 are fitted are formed. When the operator inserts the intermediate transfer unit 50 into the apparatus main body 11 at a given amount, the protrusions 541 are fitted into the recesses, and the intermediate transfer unit 50 is fixed inside the apparatus main body 11. Thus, positioning and mounting of the intermediate transfer unit 50 for the apparatus main body 11 are completed.

Figure 4:
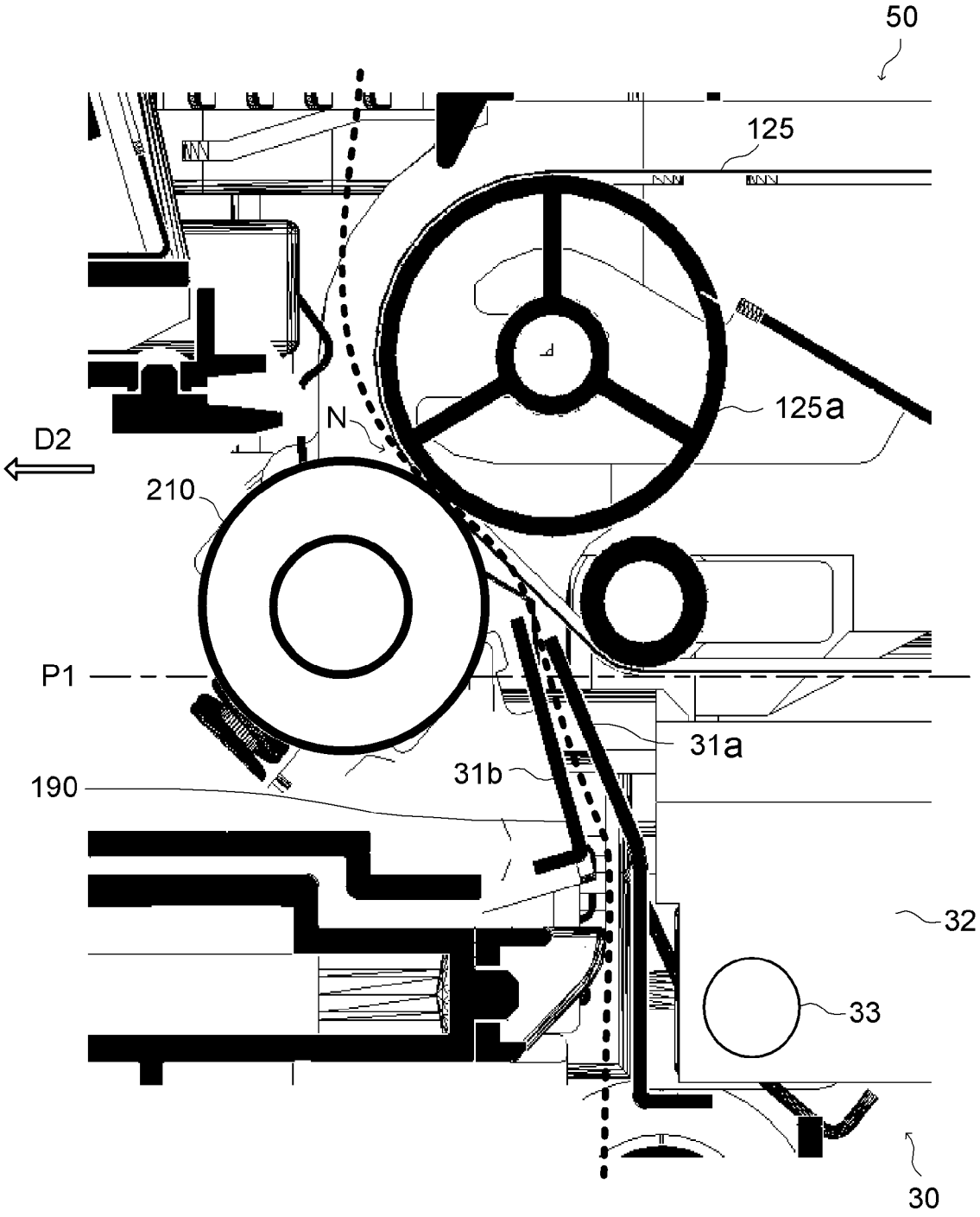
FIG. 4 is a partial cross-sectional view showing a nip zone between an intermediate transfer belt stretched on a driving roller and a secondary transfer roller, and a mechanism conveying recording paper to the nip zone.
Figure 5:
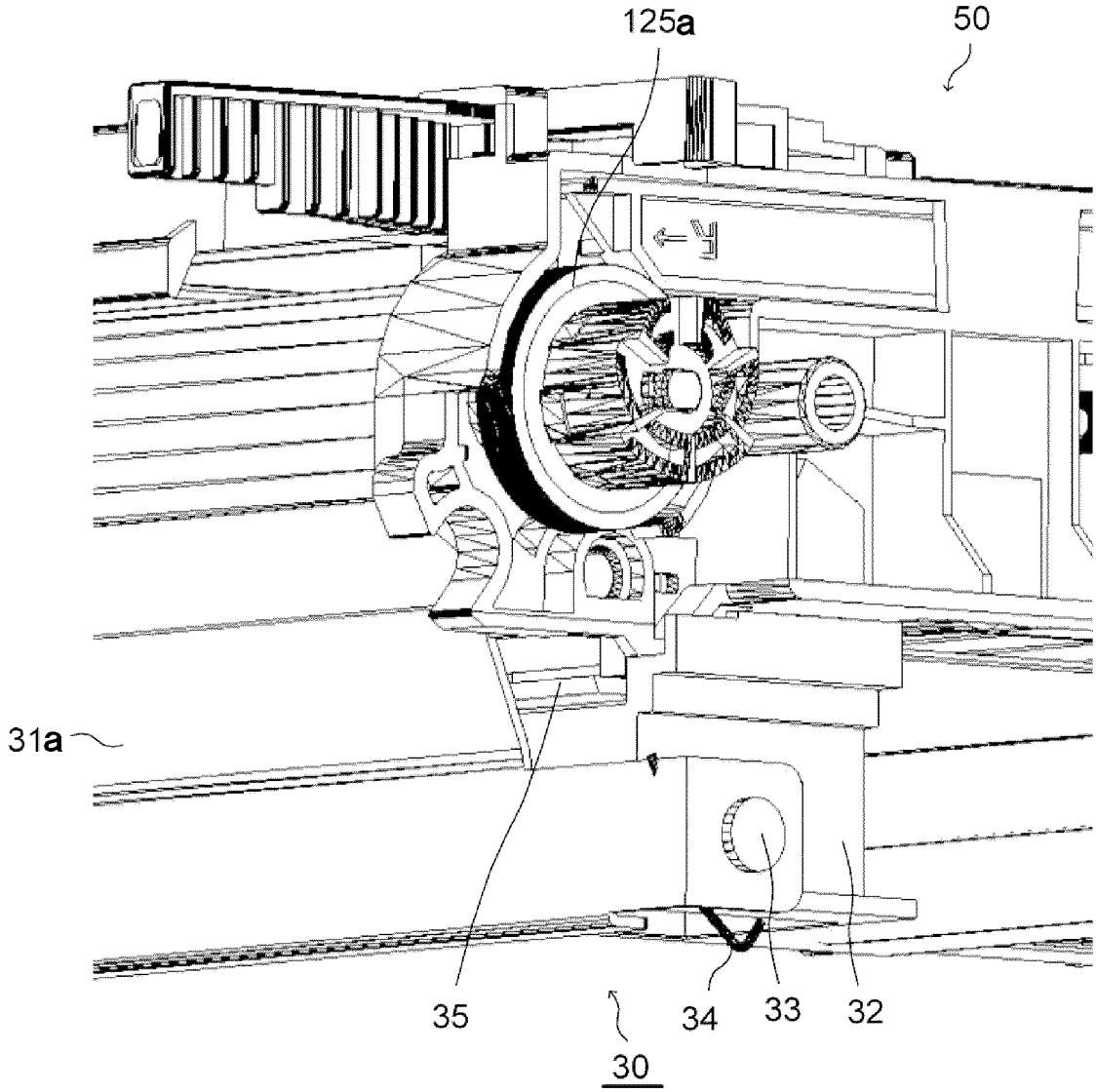
FIG. 5 is a perspective view showing portions of the intermediate transfer unit, a conveying guide, and a rotating mechanism with the door opened.

Next, mechanisms around the driving roller 125*a*, the intermediate transfer belt 125, and the secondary transfer roller 210 in the image forming apparatus 1 will be described. FIG. 4 is a partial cross-sectional view showing a nip zone between the intermediate transfer belt 125 stretched on the driving roller 125*a* and the secondary transfer roller 210, and a mechanism conveying recording paper P to the nip zone. Further, a broken line shown in FIG. 4 shows a conveying path of the recording paper, and a split position of the conveying path 190. FIG. 5 is a perspective view showing portions of the intermediate transfer unit 50, a conveying guide 31*a*, and a rotating mechanism 30 with the door 11*a* opened.

The conveying guides 31*a* and 31*b* are a part of the conveying path 190 disposed on an upstream side of the nip zone N between the intermediate transfer belt 125 stretched on the driving roller 125*a* and the secondary transfer roller 210 in a conveying direction of the recording paper P. The recording paper P is guided to the conveying guides 31*a* and 31*b*, and is conveyed up to the nip zone N by the conveyance roller 19. To cause the recording paper P to be smoothly conveyed up to the nip zone N, tip portions of the conveying guides 31*a* and 31*b* run up to the side of the nip zone N beyond an arrangement position P1 of the portion of the intermediate transfer belt 125 which becomes the uppermost stream side in the conveying direction of the recording paper P (i.e. an arrangement position which is at the uppermost stream side in the conveying direction of the recording paper P and is selected from an arrangement position of the intermediate transfer unit 50 and an arrangement position of the intermediate transfer belt 125; the same applies below). In other words, tips of the conveying guides 31*a* and 31*b* are disposed up to a position that is just in the vicinity of the nip zone N.

In the event of maintenance or replacement of the intermediate transfer unit 50, as shown in FIG. 3, an operator opens the door 11*a* of the image forming apparatus 1, so that the secondary transfer roller 210 and the conveying guide 31*b* are separated along the broken line of FIG. 4, and the nip zone N is released. The intermediate transfer unit 50 is caused to slide in the direction D2 shown in FIGS. 2 to 4 so as to be able to be demounted along with the intermediate transfer belt 125.

The conveying guide 31*a* (which is an example of a guide member) of the conveying guides 31*a* and 31*b* is configured to be able to be rotated in a housing 32 of the rotating mechanism 30 using a rotating shaft 33 as a rotating fulcrum in the direction D2, i.e., in a moving direction of the intermediate transfer unit 50 when the intermediate transfer unit 50 is mounted/demounted in/from the apparatus main body 11.

FIG. 4 shows the state in which the intermediate transfer unit 50 is mounted in the apparatus main body 11. As shown in FIG. 4, when the intermediate transfer unit 50 is mounted in the apparatus main body 11, the conveying guide 31*a* assumes a posture in which the tip thereof is located just in the vicinity of the nip zone N beyond the arrangement position P1. Thereby, when the intermediate transfer unit 50 is mounted in the apparatus main body 11, the recording paper P is precisely guided to the position located just in the vicinity of the nip zone N by the conveying guides 31*a* and 31*b*, and conveying precision of the recording paper P to the nip zone N is well maintained.

On the other hand, when the door 11*a* is opened, and the intermediate transfer unit 50 is drawn in the direction D2 shown in FIG. 4 (the side of the secondary transfer roller 210) and is demounted from the apparatus main body 11, the tip of the conveying guide 31*a* is rotated in the direction D2 using the rotating shaft 33 as the rotating fulcrum up to a position that is not beyond the arrangement position P1 in the conveying direction of the recording paper P. Thereby, when the intermediate transfer unit 50 is demounted from the apparatus main body 11, the tip of the conveying guide 31*a* is adapted to be prevented from being on the movement path of the intermediate transfer unit 50 and the intermediate transfer belt 125, and the intermediate transfer unit 50 can be easily demounted from the apparatus main body 11.

Figure 6:
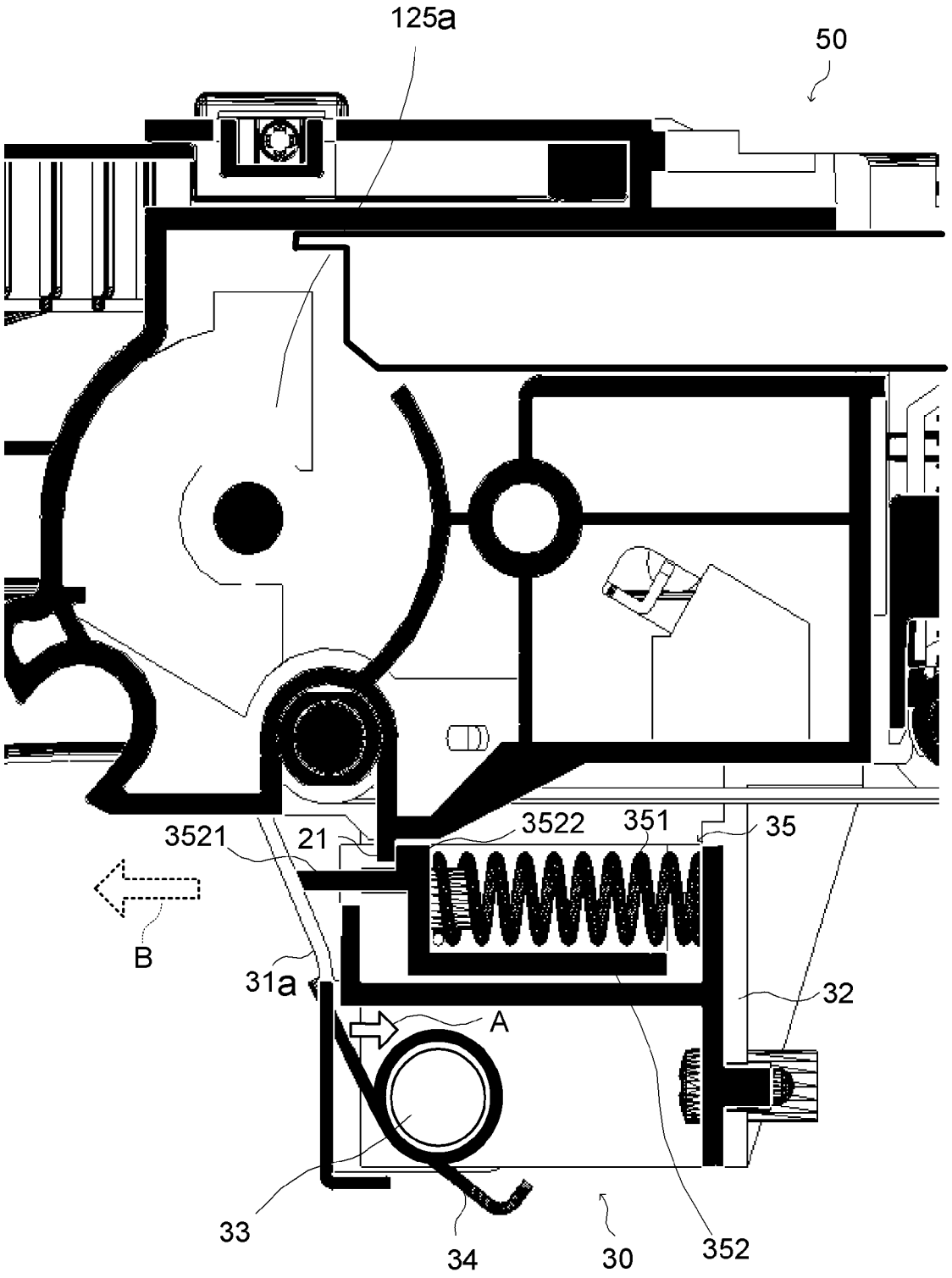
FIG. 6 is a cross-sectional view showing the intermediate transfer unit and the rotating mechanism when the intermediate transfer unit is mounted in an apparatus main body.

Next, the rotating mechanism 30 rotating the conveying guide 31*a* will be described. FIG. 6 is a cross-sectional view showing the intermediate transfer unit 50 and the rotating mechanism when the intermediate transfer unit 50 is mounted in the apparatus main body 11.

The rotating mechanism 30 is a mechanism that rotates the conveying guide 31*a* in the movement direction during demounting of the intermediate transfer unit 50 from the apparatus main body 11. The rotating mechanism 30 is equipped with a biasing member 34, a pressing member 35, and a housing 32.

The biasing member 34 is a member that biases the conveying guide 31*a* so that the conveying guide 31*a* is rotated in a direction opposite to the movement direction of the intermediate transfer unit 50 when the intermediate transfer unit 50 is demounted from the apparatus main body 11, i.e., in a direction of an arrow A shown in FIG. 6. A rotation critical point of the biasing member 34 in the direction of the arrow A caused by a biasing force of the conveying guide 31*a* is a position at which the tip of the conveying guide 31*a* becomes the posture shown in FIG. 6.

The biasing member 34 is, for instance, a torsion coil spring. The biasing member 34 is mounted on the rotating shaft 33, and is configured so that one end thereof is hooked to a lower surface of the housing 32, and the other end thereof is attached to a surface of a side facing a contact member 352 of the conveying guide 31*a*. In other words, the conveying guide 31*a* is integrally attached to the biasing member 34. Thereby, the biasing member 34 always applies a biasing force to the conveying guide 31*a* in the direction of the arrow A, i.e., toward the pressing member 35.

The pressing member 35 is a member that presses the conveying guide 31*a* in the movement direction of the intermediate transfer unit 50, i.e., in the direction of the arrow B shown in FIG. 6 (the direction D2 of FIG. 4), when the intermediate transfer unit 50 is demounted from the apparatus main body 11. The pressing member 35 is equipped with a compression spring 351 and a contact member 352. In the present embodiment, the housing 32 and the contact member 352 extend in a longitudinal direction of the conveying guide 31*a* (i.e. a depth direction of FIG. 7), but they may be provided at any position at which they can come into contact with the conveying guide 31*a* in the longitudinal direction.

The compression spring 351 is formed of a compression coil spring, and is configured so that one end thereof is mounted on an inner wall of the housing 32 fixed to the apparatus main body 11, and the other end thereof is mounted on an inner wall of the contact member 352. The compression spring 351 presses the contact member 352 toward the conveying guide 31*a*.

The contact member 352 is arranged to receive a pressing force caused by the compression spring 351 to come into contact with the conveying guide 31*a*. The contact member 352 is configured to be able to be displaced in the housing 32 toward the conveying guide 31*a* by the pressing force caused by the compression spring 351. The contact member 352 and the compression spring 351 press the conveying guide 31*a* against the biasing force caused by the biasing member 34 in the direction of the arrow B with a pressing force greater than the biasing force caused by the biasing member 34 so that the conveying guide 31*a* is rotated in the movement direction when the intermediate transfer unit 50 is demounted from the apparatus main body 11. The contact member 352 is equipped with a projection 3521 coming into contact with the conveying guide 31*a*, and an engaging part 3522 that is formed to protrude toward the intermediate transfer unit 50 and is engaged with a part of the casing 54 of the intermediate transfer unit 50. A nose 21 and the engaging part 3522 are provided at a position that is outside the end of the conveying guide 31*a* in the longitudinal direction of the conveying guide 31*a*.

The intermediate transfer unit 50 has the nose 21 engaged with the engaging part 3522. The nose 21 may be newly provided for the casing 54, and preferably uses a protrusion that is originally formed as a shape of the casing 54. The engaging part 3522 has a height extending up to a height position at which the nose 21 is present above the pressing member 35. In other words, the engaging part 3522 has a height reaching a position located on the movement path in the directions of the arrows A and B in demounting the intermediate transfer unit 50 from the apparatus main body 11.

Further, the recording medium conveying mechanism according to an embodiment of the present disclosure includes the conveying guide 31*a* and the rotating mechanism 30.

Figure 7:
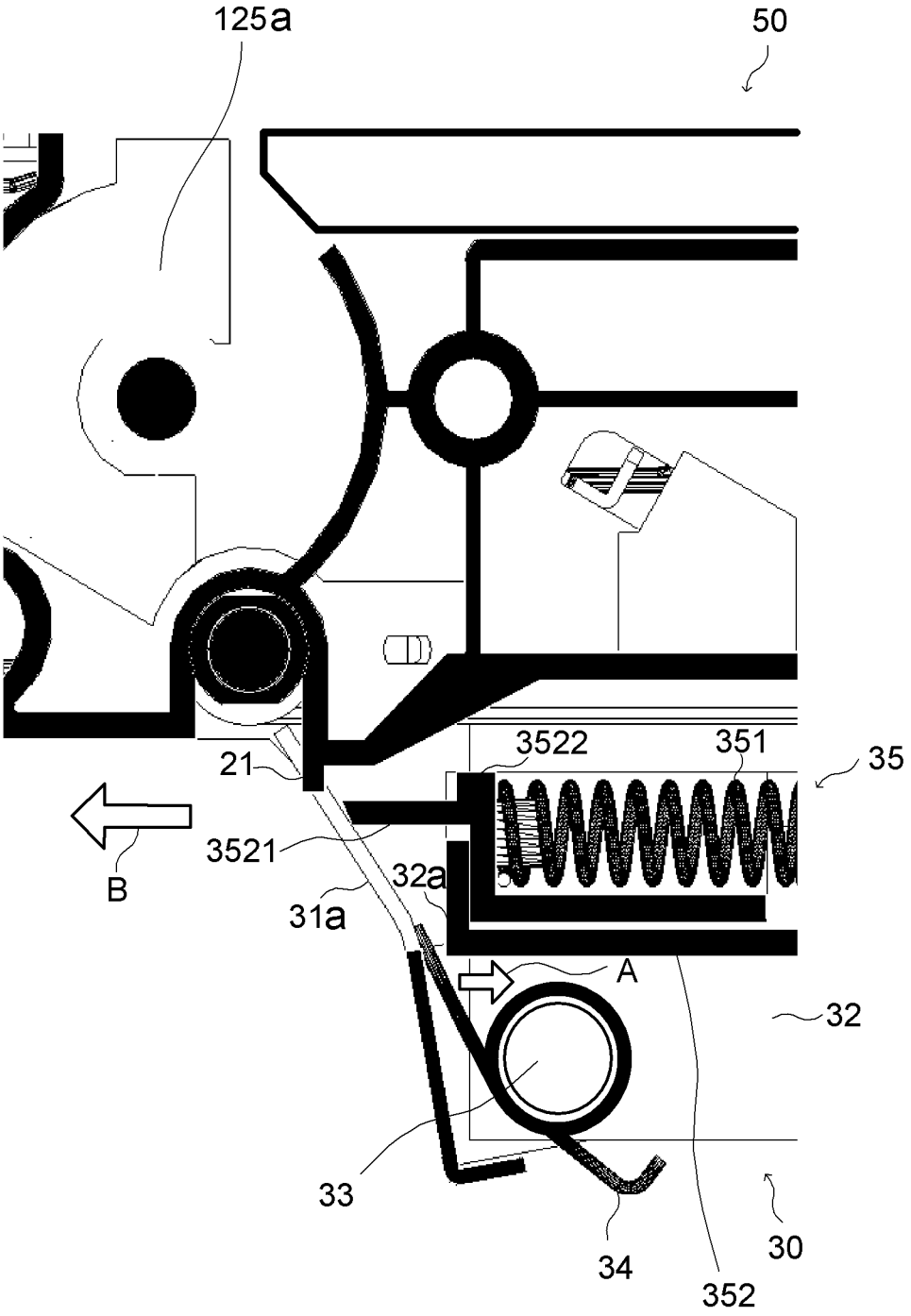
FIG. 7 is a cross-sectional view showing the intermediate transfer unit, the conveying guide, and the rotating mechanism when the intermediate transfer unit moves from a state mounted in the apparatus main body in a demounting direction.

Next, a rotating operation of the conveying guide 31*a* in demounting the intermediate transfer unit 50 from the apparatus main body 11 will be described with reference to FIG. 7 again in addition to FIGS. 4 to 6. FIG. 7 is a cross-sectional view showing the intermediate transfer unit 50, the conveying guide 31*a*, and the rotating mechanism 30 when the intermediate transfer unit 50 moves from a state mounted in the apparatus main body 11 in a demounting direction.

First, a state of the conveying guide 31*a* in mounting the intermediate transfer unit 50 in the apparatus main body 11 will be described. As described above, the engaging part 3522 formed on the contact member 352 of the pressing member 35 has the height reaching the position located on the movement path in demounting the intermediate transfer unit 50 from the apparatus main body 11. As such, when the intermediate transfer unit 50 is inserted into the apparatus main body 11, before the intermediate transfer unit 50 moves to a position at which the protrusions 541 of the intermediate transfer unit 50 are fitted into the recesses of the apparatus main body 11, the nose 21 of the intermediate transfer unit 50 is brought into contact with and engaged with the engaging part 3522 of the contact member 352.

For this reason, with the movement of the intermediate transfer unit 50 into the apparatus main body 11 in the direction of the arrow A, the contact member 352 is pushed in the direction of the arrow A which becomes a depth side of the apparatus main body 11 by the nose 21, and the compression spring 351 is contracted. The contact member 352 moves to a position at which the intermediate transfer unit 50 is completely mounted in the apparatus main body 11. When the intermediate transfer unit 50 is completely mounted and fixed in the apparatus main body 11, the pressing force caused by the compression spring 351 is suppressed and released by the engagement of the nose 21 and the engaging part 3522, and the pressing member 35 stays at that position. In other words, in this state, the position of the pressing member 35 is set to be maintained at a position at which the pressing member 35 does not press the conveying guide 31*a*.

Accordingly, with respect to the conveying guide 31*a*, the pressing force in the direction of the arrow B is not applied, but only the biasing force in the direction of the arrow A which is caused by the biasing member 34 is applied. Further, the pressing member 35 moves to the position at which the contact member 352 does not press the conveying guide 31*a*. As such, the conveying guide 31*a* is rotated up to the rotation critical point in the direction of the arrow A by the biasing force caused by the biasing member 34. For this reason, the tip of the conveying guide 31*a* is located at a position just adjacent to the nip zone N, as shown in FIGS. 4 to 6. In other words, the tip of the conveying guide 31*a* is disposed at the position beyond the arrangement position P1 in the conveying direction of the recording paper P.

Subsequently, a rotating operation of the conveying guide 31*a* which is caused by the rotating mechanism 30 in demounting the intermediate transfer unit 50 from the apparatus main body 11 will be described.

When the intermediate transfer unit 50 is demounted from the apparatus main body 11, the intermediate transfer unit 50 is drawn from the state in which it is mounted in the apparatus main body 11 and which is shown in FIGS. 4 to 6 in the direction of the arrow B. In this case, when the nose 21 of the intermediate transfer unit 50 moves in the direction of the arrow B, the engaging part 3522 of the contact member 352 which is engaged with the nose 21 by the pressing force caused by the compression spring 351 similarly moves in the direction of the arrow B with the movement of the nose 21. Here, the pressing force of the compression spring 351 is greater than the biasing force of the biasing member 34 rotating the conveying guide 31*a* in the direction of the arrow A. As such, the conveying guide 31*a* is pressed by the contact member 352 of the pressing member 35, and is rotated in the direction of the arrow B, i.e., in the movement direction of the intermediate transfer unit 50 and the intermediate transfer belt 125 when demounted from the apparatus main body 11.

Then, the pressing member 35 moves to a position at which it is locked on an end 32*a* of the housing 32, and the movement in the direction of the arrow A is restricted by the locking. After the pressing member 35 is locked on the end 32*a* of the housing 32, the rotation of the conveying guide 31*a* in the direction of the arrow A due to the biasing force of the biasing member 34 is restricted by the contact with the projection 3521 of the contact member 352, and is stopped at a position shown in FIG. 7. The conveying guide 31*a* stays in a posture locked on a tip of the projection 3521 located at such a position, and is held in a posture shown in FIG. 7.

In this case, as shown in FIG. 7, the stopped position of the conveying guide 31*a* is set to a position at which, in FIG. 7, the tip of the conveying guide 31*a* is located lower than the movement path of the intermediate transfer unit 50 and the intermediate transfer belt 125 in demounting the intermediate transfer unit 50 from the apparatus main body 11, i.e., a position that does not exceed the arrangement position P1 of the portions of the intermediate transfer unit 50 and the intermediate transfer belt 125 which becomes the uppermost stream side in the conveying direction of the recording paper P toward the nip zone N.

Thereby, when the intermediate transfer unit 50 is demounted from the apparatus main body 11, the tip of the conveying guide 31*a* does not interfere with the intermediate transfer unit 50 and the intermediate transfer belt 125. As such, in spite of the presence of the conveying guide 31*a*, the intermediate transfer unit 50 can be easily demounted from the apparatus main body 11, and operability of the intermediate transfer unit 50 is improved in the event of maintenance and replacement of the intermediate transfer unit 50.

Figure 8:
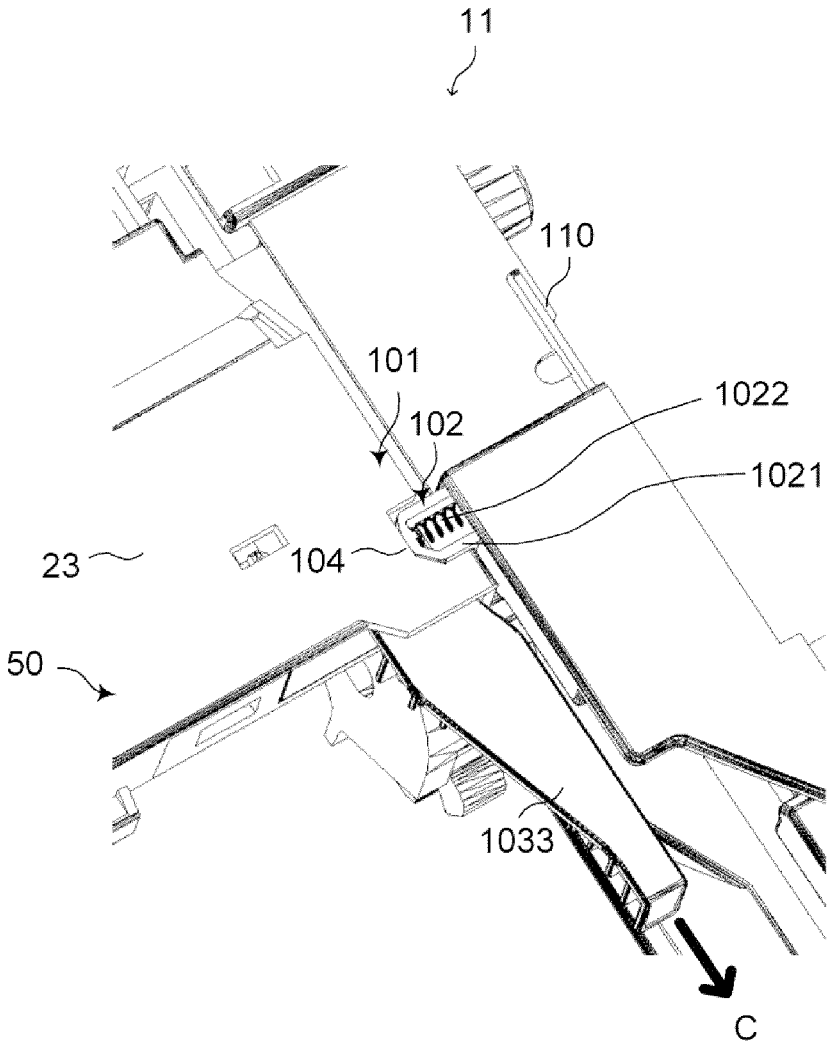
FIG. 8 is a partial perspective view showing the intermediate transfer unit and a locking mechanism in a state in which the intermediate transfer unit is mounted in the apparatus main body.
Figure 9:
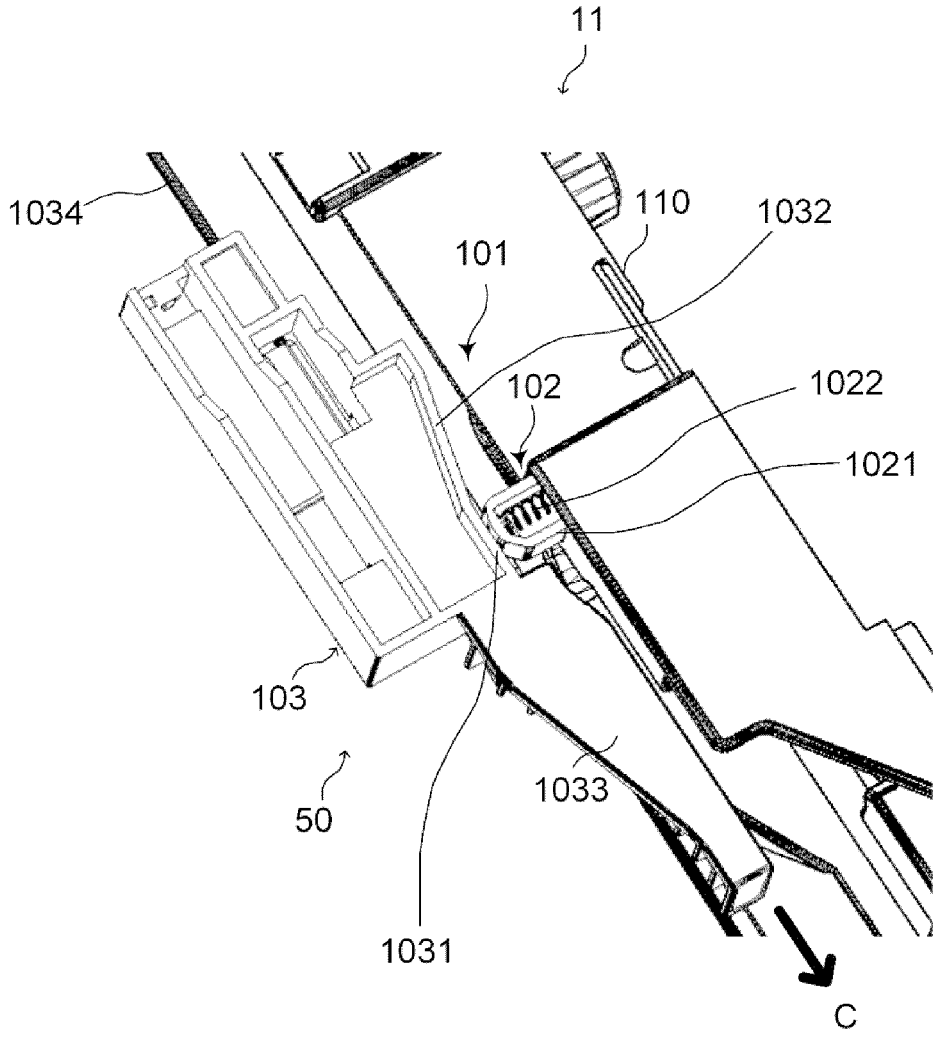
FIG. 9 is a perspective view showing an internal structure of a locking member in the state in which the intermediate transfer unit is mounted in the apparatus main body.
Figure 10:
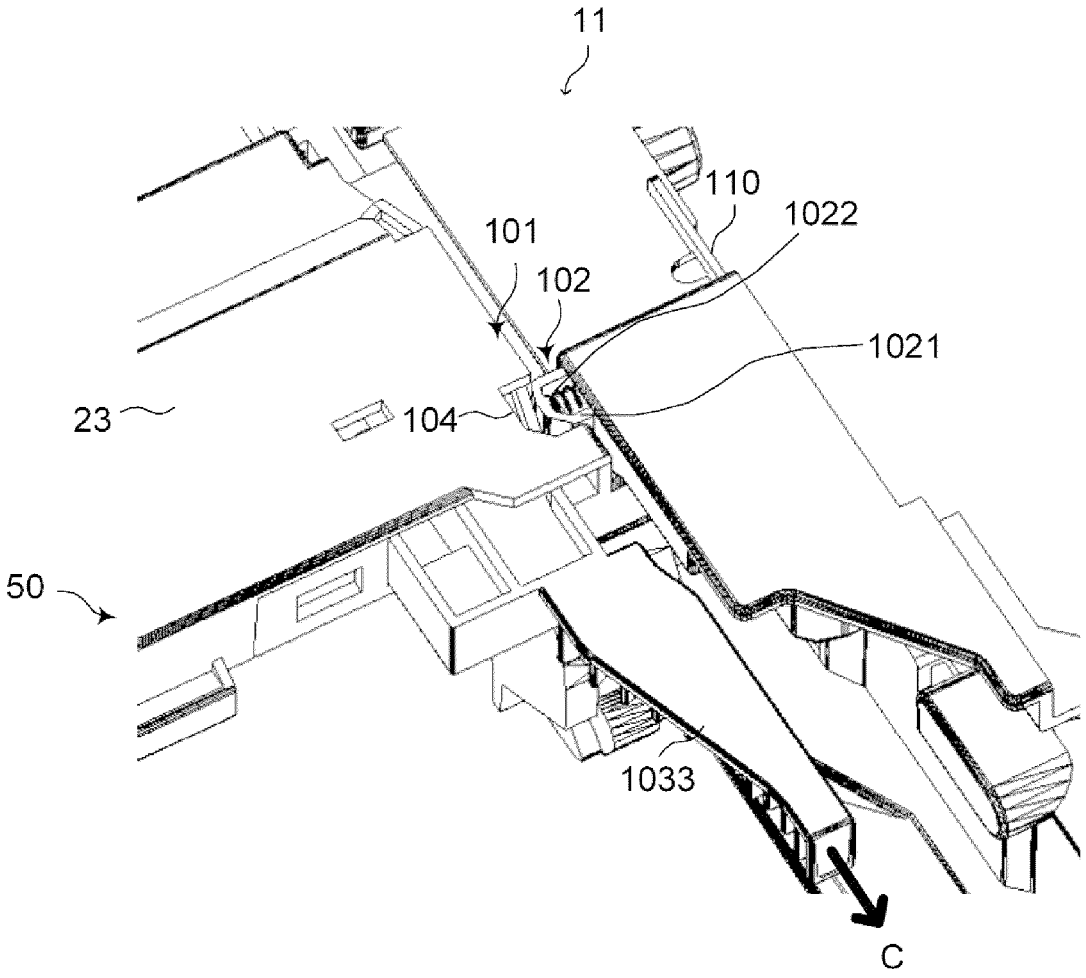
FIG. 10 is a partial perspective view showing the intermediate transfer unit and the locking mechanism in a state in which the intermediate transfer unit moves to a direction in which it is demounted from the apparatus main body.
Figure 11:
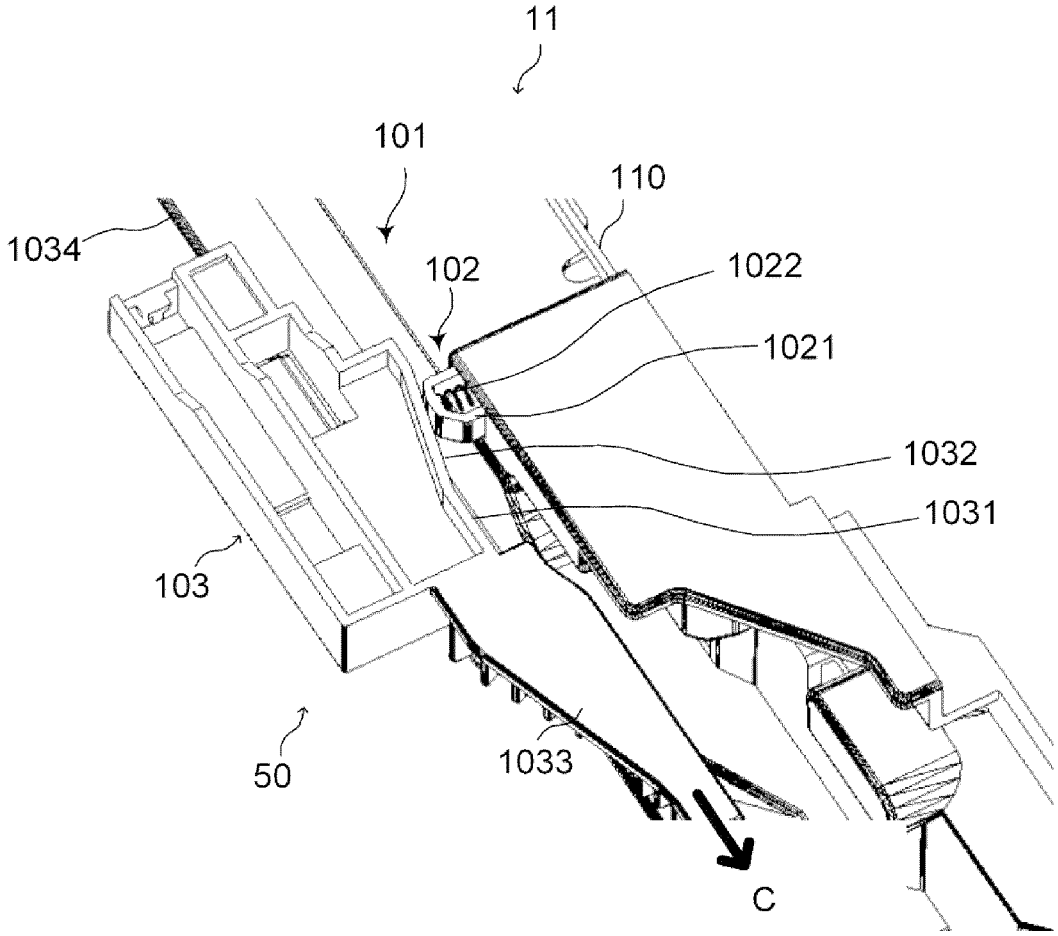
FIG. 11 is a partial perspective view showing the locking member in the state in which the intermediate transfer unit moves to the direction in which it is demounted from the apparatus main body.

Next, a mechanism for mounting/demounting the intermediate transfer unit 50 with respect to the apparatus main body 11 will be described. FIG. 8 is a partial perspective view showing the intermediate transfer unit 50 and a locking mechanism 101 in a state in which the intermediate transfer unit 50 is mounted in the apparatus main body 11. FIG. 9 is a perspective view showing an internal structure of the locking member 102 in that state. FIG. 10 is a partial perspective view showing the intermediate transfer unit 50 and the locking mechanism 101 in the state in which the intermediate transfer unit 50 moves to a direction in which it is demounted from the apparatus main body 11. FIG. 11 is a partial perspective view showing the locking member 102 in that state.

As described above, when the intermediate transfer unit 50 is mounted in the apparatus main body 11, the nose 21 of the intermediate transfer unit 50 is engaged with the engaging part 3522 of the pressing member 35, and the contact member 352 stays at the position at which it does not press the conveying guide 31*a* with the compression spring 351 contracted as shown in FIG. 6. However, in this state, the intermediate transfer unit 50 receives the pressing force in the direction of the arrow A from the compression spring 351. The apparatus main body 11 and the intermediate transfer unit 50 are provided with a locking mechanism 101 that inhibits the intermediate transfer unit 50 from moving in the movement direction of the intermediate transfer unit 50 when demounted from the apparatus main body 11 so that the intermediate transfer unit 50 is fixed against the pressing force at the position at which it is mounted in the apparatus main body 11.

The locking mechanism 101 has a locking member 102 provided on the side of the apparatus main body 11, a locking guide 103 provided on the side of the intermediate transfer unit 50, and a cutout 104 formed in a frame 23.

The locking member 102 is provided for a portion of a unit guide 110 which becomes a lateral part of the intermediate transfer unit 50 mounted in the apparatus main body 11. The unit guide 110 is a part of the apparatus main body 11, and guides movement in mounting/demounting the intermediate transfer unit 50 in/from the apparatus main body 11.

The locking member 102 has a housing 1021 and a compression spring 1022. The housing 1021 is provided to be retractable from the portion of the apparatus main body 11, and moves in the contacting/separating direction relative to the intermediate transfer unit 50. One end of the compression spring 1022 is mounted inside the housing 1021. The other end of the compression spring 1022 is provided for the unit guide 110. Thereby, the locking member 102 made up of the housing 1021 and the compression spring 1022 is always biased toward the intermediate transfer unit 50, and protrudes from the unit guide 110. When receiving a pressure against the pressing force of the compression spring 1022, the locking member 102 moves in a direction in which it goes into the unit guide 110.

The locking guide 103 is installed on the intermediate transfer unit 50. The locking guide 103 has a plane part 1031 made up of a face parallel to the direction in which the intermediate transfer unit 50 is drawn from the apparatus main body 11 (i.e. a direction of an arrow C shown in FIGS. 8 and 9), a slope part 1032 made up of an inclined face gradually extending from the plane part 1031 toward the portion of the unit guide 110 of the apparatus main body 11, and a lever 1033.

The locking guide 103 is installed on the intermediate transfer unit 50 so as to be able to be displaced in the drawing direction (the direction of the arrow C) with respect to a main body of the intermediate transfer unit 50 by movement along the guide rail 1034. Although not separately shown, the locking guide 103 has a lock locked with the frame 23 in order to stop the movement in the drawing direction so as not to deviate from the intermediate transfer unit 50. Further, a cutout 104 fitted with the locking member 102 is formed in the frame 23 of the intermediate transfer unit 50.

When the intermediate transfer unit 50 is still mounted in the apparatus main body 11, as shown in FIGS. 8 and 9, the locking guide 103 is kept introduced into a position that becomes a deepest side (an inner side of the apparatus main body 11) in the drawing direction with respect to the frame 23. In this case, the cutout 104 and the plane part 1031 are still located at the portion of the intermediate transfer unit 50 which faces the locking member 102. In this state, the intermediate transfer unit 50 has a space housing the locking member 102 protruding from the side of the apparatus main body 11. As such, the locking member 102 protrudes toward the intermediate transfer unit 50 due to the pressing force caused by the compression spring 1022. A tip of the protruding locking member 102 is fitted into the cutout 104 while coming into contact with the plane part 1031. Thereby, the locking member 102 is locked on the intermediate transfer unit 50, and the movement of the intermediate transfer unit 50 in the drawing direction is restricted.

Further, an operator operates and pulls the lever 1033 in the drawing direction from the state in which the intermediate transfer unit 50 is mounted in the apparatus main body 11, and draws the intermediate transfer unit 50 from the apparatus main body 11 in the drawing direction. Thereby, the intermediate transfer unit 50 can be demounted from the apparatus main body 11. When the operator pulls the lever 1033 in the drawing direction, the position of the intermediate transfer unit 50 relative to the apparatus main body 11 is not changed, and the locking guide 103 is drawn from the frame 23 first.

In this case, the tip of the locking member 102 coming into contact with the plane part 1031 of the locking guide 103 slides on the plane part 1031 to move to the slope part 1032 with the movement of the locking guide 103. Here, the locking member 102 receives a pressing force against the compression spring 1022 from the slope part 1032 rising in the direction of the unit guide 110 with the movement of the locking guide 103, and is pushed into the unit guide 110. For this reason, as shown in FIGS. 10 and 11, the state in which the locking member 102 is fitted into the cutout 104 is released, and the locking of the intermediate transfer unit 50 cased by the locking member 102 is released. The restriction of the movement of the drawing direction caused by the locking member 102 is released.

In this way, when the restriction of the movement of the intermediate transfer unit 50 in the drawing direction is released, as shown in FIG. 7, the nose 21 of the intermediate transfer unit 50 is pressed by the compression spring 351 of the pressing member 35, and the intermediate transfer unit 50 is pushed out in the drawing direction. Thereby, the operator can easily recognize that the intermediate transfer unit 50 can be demounted. The operability when the intermediate transfer unit 50 is demounted from the apparatus main body 11 is improved by the movement of the intermediate transfer unit 50 in the drawing direction.

Further, when the intermediate transfer unit 50 is mounted in the apparatus main body 11, the operator inserts the intermediate transfer unit 50 relative to the apparatus main body 11, and returns the locking guide 103 of the state shown in FIGS. 10 and 11 back to the state shown in FIGS. 8 and 9 by pushing the lever 1033. Thereby, the locking member 102 is fitted into the cutout 104 again, and the locking member 102 is locked on the intermediate transfer unit 50. The movement of the intermediate transfer unit 50 in the movement direction is restricted, and the intermediate transfer unit 50 is held in the state in which it is mounted in the apparatus main body 11.

In a typical image forming apparatus, the recording paper is conveyed to the nip zone between the intermediate transfer belt and the secondary transfer roller along the conveying guide forming a part of the conveying path. Then, the tip of the conveying guide in the recording paper conveying direction extends up to the position just adjacent to the nip zone so that the recording paper is smoothly conveyed to the nip zone. For this reason, the tip of the conveying guide runs up to just the vicinity of the nip zone beyond the arrangement position of the intermediate transfer belt portion that becomes the uppermost stream side in the conveying direction of the recording paper. In the image forming apparatus having such a structure, when the intermediate transfer unit is demounted at the side of the secondary transfer roller, the conveying guide is fixedly disposed in the apparatus main body, and the tip thereof is present on the movement path of the intermediate transfer belt when the intermediate transfer unit is demounted. As such, the intermediate transfer unit cannot be demounted without demounting the conveying guide, and the operability when the intermediate transfer unit is mounted/demounted in/from the apparatus main body of the image forming apparatus is reduced. On the other hand, when the position of the tip of the conveying guide is separated from the nip zone up to a position at which the tip of the conveying guide is not present on the movement path of the intermediate transfer belt when the intermediate transfer unit is demounted in order to improve the operability in the event of the maintenance, and the conveying guide is disposed, the recording paper cannot be smoothly conveyed to the nip zone, and image defects may take place.

In contrast, according to the embodiment in the present disclosure, when the intermediate transfer unit 50 is mounted in the apparatus main body 11 of the image forming apparatus 1, the tip of the conveying guide 31*a* is disposed up to the nip zone between the intermediate transfer belt 125 and the secondary transfer roller 210 beyond the arrangement position of the portion of the intermediate transfer belt 125 which becomes the uppermost stream side in the conveying direction of the recording paper. As such, conveying precision of the recording paper to the nip zone is maintained well. On the other hand, when the intermediate transfer unit 50 is demounted from the apparatus main body, the tip of the conveying guide 31*a* is rotated up to the position that does not exceed the arrangement position of the portion of the intermediate transfer belt 125. When the intermediate transfer unit 50 is demounted, the tip of the conveying guide 31*a* is not present in the movement direction of the intermediate transfer belt 125. As such, without demounting the conveying guide 31*a* from the apparatus main body 11, the intermediate transfer unit 50 can be easily demounted from the apparatus main body 11.

Thus, according to the embodiment in the present disclosure, the operability when the intermediate transfer unit 50 is mounted/demounted in/from the apparatus main body 11 of the image forming apparatus 1 can be improved, while the conveying precision of the recording paper to the nip zone between the intermediate transfer belt 125 and the secondary transfer roller 210 is maintained well.

The contents of the present disclosure are not limited to the constitution of the embodiment, and various modifications are possible. For example, one embodiment of the image forming apparatus according to the present disclosure has been described using a multifunction device. However, this is merely one example. For example, another image forming apparatus such as a printer, a copier, or a facsimile device may be used.

Further, in the embodiment, the constitution and processing shown in the embodiment using FIGS. 1 to 11 are merely one embodiment of the present disclosure, and the contents of the present disclosure are not intended to limit to the constitution and processing.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A recording medium conveying mechanism comprising:

a conveying guide whose tip runs up to a nip zone between an intermediate transfer belt mounted on an intermediate transfer unit and a secondary transfer roller disposed to face the intermediate transfer belt beyond an arrangement position of a portion of the intermediate transfer belt at an uppermost stream side in a conveying direction of a recording medium, and which guides movement of the recording medium conveyed toward the nip zone;

a rotating mechanism; and a guide member that is a portion of the conveying guide having the tip, is rotated by the rotating mechanism when the intermediate transfer unit is mounted/demounted relative to an apparatus main body of an image forming apparatus, and is rotated toward a position at which the tip does not exceed the arrangement position of the intermediate transfer belt portion in the conveying direction of the recording medium when the intermediate transfer unit is mounted/demounted, in a movement direction of the intermediate transfer unit during the mounting/demounting.

2. The recording medium conveying mechanism according to claim 1, wherein:

the rotating mechanism includes a biasing member that biases the guide member so that the guide member is rotated in a direction opposite to the movement direction of the intermediate transfer unit when the intermediate transfer unit is demounted from the apparatus main body, and a pressing member that is disposed in contact with the biasing member and presses the guide member so that the guide member is rotated against a biasing force caused by the biasing member in the movement direction during the demounting by a pressing force greater than the biasing force;

the pressing member has an engaging part engaged with a part of the intermediate transfer unit mounted in the apparatus main body;

when the intermediate transfer unit is mounted in the apparatus main body, the guide member is withheld at a position at which the engaging part does not press the guide member by engagement with a part of the intermediate transfer belt; and when the intermediate transfer unit moves in the movement direction during the demounting, and the withholding caused by the engagement is released, the pressing member presses the guide member and causes the guide member to be rotated up to a position at which a tip of the guide member does not exceed the arrangement position of the intermediate transfer belt portion.

3. An image forming apparatus comprising:

the recording medium conveying mechanism according to claim 1;

the intermediate transfer unit;

the secondary transfer roller; and a locking mechanism switching restriction of the movement of the intermediate transfer unit mounted in the apparatus main body in the movement direction during the demounting, and release of the restriction, wherein the image forming apparatus is configured so that, when the movement restriction caused by the locking mechanism is released when the intermediate transfer unit is demounted from the apparatus main body, the pressing member presses the engaging part, and the intermediate transfer unit moves in the direction during the demounting.

4. The image forming apparatus according to claim 3, wherein:

the locking mechanism includes a locking member and a locking guide;

a cutout fitted with the locking member is formed in the intermediate transfer unit;

the locking member is installed to be freely projected or retreated from the apparatus main body of the image forming apparatus toward the intermediate transfer unit, is fitted into the cutout when projected toward the intermediate transfer unit, and restricts the movement of the intermediate transfer unit in the direction during the demounting, and the locking guide is installed to be movable toward the intermediate transfer unit independently of the intermediate transfer unit, pushes the locking member into the apparatus main body when moving in the direction during the demounting, and releases a state in which the locking member is fitted into the cutout.

5. The image forming apparatus according to claim 4, wherein:

the locking guide has a plane part made up of a face parallel to the direction during the demounting, and a slope part made up of an inclined face gradually extending from the plane part toward the apparatus main body;

when the intermediate transfer unit is still mounted in the apparatus main body, the cutout and the plane part of the locking guide are located at the intermediate transfer unit portion facing the locking member, and the locking member protrudes from the apparatus main body, is fitted into the cutout, and comes into contact with the plane part; and when the locking guide moves in the direction during the demounting, the locking member coming into contact with the plane part of the locking guide is pushed into the side of the apparatus main body by the slope part, and the fitted state with the cutout is released.

* * * * *